United States Patent [19]

Jennings et al.

[11] Patent Number: 4,671,360

[45] Date of Patent: Jun. 9, 1987

[54] HIGH IMPULSE ENERGY AND LIQUID MEMBRANE SCALE REMOVAL

[75] Inventors: Alfred R. Jennings, Plano; Ernest L. Muegge, Grand Prairie; Peggy M. Wilson, Dallas, all of Tex.

[73] Assignee: Mobil Oil Corporation, New York, N.Y.

[21] Appl. No.: 886,997

[22] Filed: Jul. 18, 1986

Related U.S. Application Data

[63] Continuation-in-part of Ser. No. 770,928, Aug. 30, 1985, Pat. No. 4,621,694.

[51] Int. Cl.[4] ..... E21B 37/00; E21B 37/08

[52] U.S. Cl. ..... 166/312

[58] Field of Search ..... 166/279, 304, 310, 311, 166/312, 256, 257, 261, 63; 252/8.55 D; 299/299, 3, 13, 14

[56] References Cited

U.S. PATENT DOCUMENTS 4,605,061 8/1986 Jennings, Jr. ..... 166/63

4,621,694 11/1986 Wilson et al. ..... 166/312

*Primary Examiner*—Stephen J. Novosad

*Assistant Examiner*—Thomas J. Odar

*Attorney, Agent, or Firm*—Alexander J. McKillop; Michael G. Gilman; Charles A. Malone

[57] ABSTRACT

A process wherein energy generated from a high impulse device is used to jar, loosen, or dislodge scale from a wellbore, downhole production equipment, or near well formation flow channels. Such jarred, loosened, or dislodged scale allows for increased amounts of scale-forming ions to be removed. Alterwards, an emulsified liquid membrane system containing surfactants therein sufficient to remove scale-forming ions is placed in said wellbore. Said emulsified membrane system is removed when the scale-forming ions have been absorbed therein.

30 Claims, 2 Drawing Figures

HIGH IMPULSE ENERGY AND LIQUID MEMBRANE SCALE REMOVAL

This invention is a continuation-in-part of application Ser. No. 770,928 which was filed on Aug. 30, 1985 U.S. Pat. No. 4,621,694.

FIELD OF THE INVENTION

This invention is directed to a method for the removal of scale found in oil and gas equipment used above and below ground wherein a liquid membrane system in combination with a high energy impulse device is utilized.

BACKGROUND OF THE INVENTION

Many wells produce from a hydrocarbonaceous bearing formation which also produces formation water. Often this water is rich in minerals. These minerals have a tendency to precipitate out of solution when said water encounters lowered wellbore temperatures during production or when the water mixes with water from another source. Frequently, these precipitates form scale which deposit on downhole metal surfaces. In addition to downhole metal surfaces, said scale can also build up in conventional well completions and in gravel packs if the mixing, temperature and pressure conditions are within a certain range. Many scales so deposited are not readily reactive with acid solutions or other solvents. In some instances the scale must be removed by mechanical means, such as scrapers.

Therefore, what is needed is a method to remove scale from a wellbore, downhole production equipment, formation perforations, or near well flow channels which method will not cause damage when removing the adhering scale.

SUMMARY OF THE INVENTION

This invention is directed to a method for removing scale from a wellbore, downhole production equipment, perforations, and near wellbore flow channels used to produce hydrocarbonaceous fluids. In the practice of this invention, a high energy impulse device is placed within said wellbore. Said device is capable of generating energy sufficient to loosen or dislodge scale deposits from said wellbore, production equipment, perforations, and near well flow channels without damaging said wellbore, production equipment, perforations, or fluid channels. Energy emanating from said device is kept below those values which would fracture the formation.

Said device is ignited whereupon sufficient energy is generated to jar the wellbore, said equipment, and formation sufficiently to loosen or dislodge scale deposits adhering thereto. The loosened deposits fall into the wellbore and areas adjacent thereto. In order to remove the loosened or dislodged scale from the wellbore, said equipment, and formation, an emulsified liquid membrane system is directed into the wellbore.

As pumped into the wellbore, said emulsified liquid membrane comprises a three-phase emulsion. The emulsion includes an aqueous external phase and an aqueous internal phase, separated by a liquid hydrocarbon phase. The hydrocarbon phase is immiscible with the two said aqueous phases and it contains a first complexing agent. This complexing agent is capable of forming a complex with one or more of the ions in the scale-forming compound or deposit. Complexes of ions with said first complexing agent are soluble in said hydrocarbon phase. An internal aqueous phase is contained in and is immiscible with the hydrocarbon phase. The internal aqueous phase contains a second complexing agent capable of forming a second complex with said scale-forming ions. The strength of the complex of the scale-forming ions and said second complexing agent is much greater than the strength of the complex of the scale-forming ions and the first complexing agent. Scale-forming ions form scales which dissolve slowly into the aqueous external phase. These ions are complexed in the hydrocarbon membrane phase and are then drawn into the aqueous internal phase because of the stronger complexing strength of the second complexing agent. Weak and difficult to dissolve scales of barium and/or strontium sulfate are thereby removed from borehole perforations, downhole metal equipment surfaces, and are prevented from redepositing.

It is therefore an object of this invention to provide an efficient and novel way to remove scale from oil and gas production equipment after said scale has been loosened and dislodged by energy from a high energy impulse device.

It is a further object of this invention to remove intractable barium or strontium sulfate scale, or other similar scale generally found downhole in hydrocarbonaceous fluid producing equipment after said scale has been loosened and dislodged by energy from a high energy impulse device.

A still yet further object of this invention is to utilize a high energy impulse device to jar, loosen, and dislodge scale from downhole production equipment and perforations without damaging said equipment, formation or perforations.

A still yet even further object of this invention is to utilize a high energy impulse device to jar, loosen, and dislodge scale from surface equipment, including flowlines, and vessels without damaging said equipment, flowlines, or vessels.

DESCRIPTION OF PREFERRED EMBODIMENTS

Figure 1:
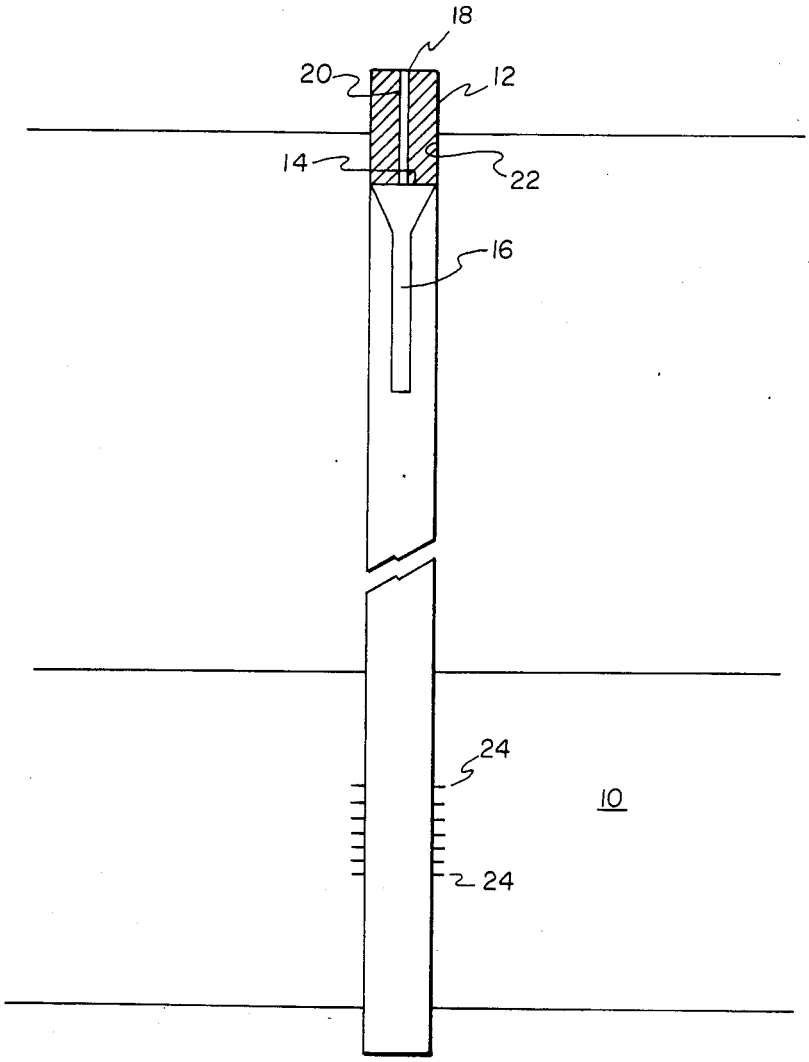
FIG. 1 is a graphic representation of the gel plug and canister containing the propellant before ignition.

In the practice of this invention, referring to FIG. 1, a canister containing a propellant 16 is placed into a wellbore 12 which penetrates a hydrocarbonaceous fluid producing formation 10. Canister 16 is suspended into wellbore 12 via a retrieval means, which generally will be a cable 18. In order to ignite the propellant contained in the canister 16, a means for igniting the propellant is connected to retainer stem 14. Retainer stem 14 forms an integral part of the canister and is positioned on its upwardly directed end. The other end of a means for ignition is connected or affixed to a location at or above ground level above wellbore 12. The means for ignition will generally be a conduit 20 containing an electrical wire which wire can be used to generate an electrical spark within canister 16 containing the propellant.

After positioning retainer stem 14 at a desired level in the wellbore, a pumpable gel mixture is placed into the wellbore above retainer stem 14. After from about 2 hours to about 4 hours, the pumpable gel mixture solidifies. As will be understood by those skilled in the art, the composition of the mixture can be varied to obtain the desired rigidity in the gel stem. One method of making a suitable pumpable mixture is discussed in U.S. Pat. No. 4,333,461 which issued to Muller on June 8, 1982 and which is hereby incorporated by reference. Upon solidification, the pumpable gel mixture forms a gel plug stem 22. The stability and rigidity of the gel plug stem 22 will depend upon the physical and chemical characteristics of said gel plug stem. As is known to those skilled in the art, the gel plug stem should be of a stability and rigidity which will absorb the shock from ignition of the propellant contained in the canister 16. Generally, pressures generated upon ignition will vary from about 1,000 psig to about 30,000 psig. The pressures generated will be sufficient to loosen or dislodge scale while avoiding damage to the formation's productive interval. Instantaneous heat generated upon ignition of the propellant may be about 1,000° F. in the vicinity of the deflagration but is quickly dissipated with propagation. The retainer stem which is below solidified gel plug 22 forms an integral part of the canister when it is suspended into the wellbore from a location at or above the ground level. A more detailed description of a method for making a gel plug is described in my allowed pending U.S. application, Ser. No. 625,430 which was filed on June 28, 1984. This application is hereby incorporated by reference.

Upon ignition of the propellant, heat and pressure are released within the wellbore and into the productive interval of the formation. Often, the energy released is sufficient not only to jar, loosen, and dislodge scale within the wellbore but also acts similarly on scale adhering to the perforations 24, and/or flow channels. Any charge or propellant used should develop sufficient energy to jar the wellbore and loosen the scale without damaging the formation or fracturing the formation. Upon jarring the wellbore and formation, the high impulse energy will expose more surface area of scale to reaction by chemicals for further cleanup. Said energy also facilitates the mechanical removal of scale from the wellbore and perforations 24. The amount of charge or propellant used to remove scale from the wellbore, downhole production equipment, and productive interval without damaging or fracturing the formation will depend on the environmental factors of a particular formation, as is known to those skilled in the art. Once said scale has been sufficiently loosened or dislodged from said wellbore, production equipment, perforations, and flow channels, it can be removed by either mechanical or chemical means. By altering the propellant charge, energy can be generated sufficient to dislodge scale from flowlines and surface equipment such as vessels without damaging said vessels or flowlines.

A preferred method of removal is by a chemical means which employs a liquid membrane system. This scale removal system is more particularly described in allowed pending U.S. application bearing Ser. No. 770,928, filed Aug. 30, 1985. This application is hereby incorporated by reference in its entirety.

Once the pressure and heat have dissipated, the well is opened and a liquid membrane system is directed into wellbore 12 after removal of fluids from said wellbore. Said system is allowed to remain in said wellbore and contact downhole production equipment, perforations, and flow channels for a time sufficient to dissolve scale forming ions into an external aqueous phase of said liquid membrane system. The liquid membrane system comprises an emulsion containing a hydrocarbonaceous membrane phase which encases droplets of an internal aqueous phase mixed with an external aqueous phase and is injected into the wellbore. The internal aqueous phase is thus separated from the external aqueous phase by the hydrocarbonaceous containing liquid membrane phase. Upon injection into the wellbore, the external aqueous phase bathes and contacts scale deposited in bore-hole perforations and other areas within the formation including flow channels.

$BaSO_4$, $SrSO_4$, $CaSO_4$, and $CaCO_3$ are dissolved in the external aqueous phase at low concentrations. $Ba^{++}$, $Sr^{++}$ and $Ca^{++}$ ions are collected in the liquid membrane phase by a complexing agent. Afterwards, said ions diffuse through said liquid membrane into the encased droplets in the internal aqueous phase. These ions continually accumulate in droplets of the internal aqueous phase which contains a second complexing agent. The composition of said second complexing agents is such that the accumulation of said ions is markedly greater than the concentration in said external aqueous phase. Continuous migration of said ions into the external aqueous phase into the liquid membrane phase and into droplets of said internal aqueous phase causes scale to be progressively and continuously removed from surfaces where they have been deposited.

Once the liquid membrane system has become saturated, has reached its capacity to retain scale-forming ions, or has removed the scale deposit, the emulsion is removed from the wellbore and subjected to a demulsification process to remove the scale-forming ions from the liquid internal aqueous phase and the hydrocarbonaceous liquid membrane phase. A method for removal of inorganic species by a liquid membrane process is disclosed by Li et al. in U.S. Pat. No. 3,637,488 which is hereby incorporated by reference. Methods for demulsification of the liquid membrane can be found in U.S. Pat. No. 4,292,181 issued to Li et al. which is hereby incorporated by reference herein.

A wide range of temperatures may be utilized in the process of the instant invention since temperature is not critical. There would, however, be a lower and an upper limit which would be imposed for preventing separation of a liquid membrane system. The lowest temperature should be higher than the freezing temperature of any of the liquids contacted, such as the well water. It will also have to be higher than the freezing temperature of the emulsified aqueous mixture so that mass transfer will be facilitated. Since liquid membrane permeation rates increase with increasing temperature, as high a temperature as possible should be employed. Typical temperatures can vary from above about 0° to about 60° C., preferably about 25° to about 40° C. and would most preferably be ambient. These ambient temperatures will generally be encountered when mixing the emulsified aqueous mixture above ground.

Downhole temperatures in a hydrocarbonaceous well can vary from about 15° C. to about 200° C. depending upon the well depth. Temperatures up to about 200° C. will not affect the emulsified aqueous mixture, providing appropriate emulsifying agents are used, as is known to those skilled in the art.

Figure 2:
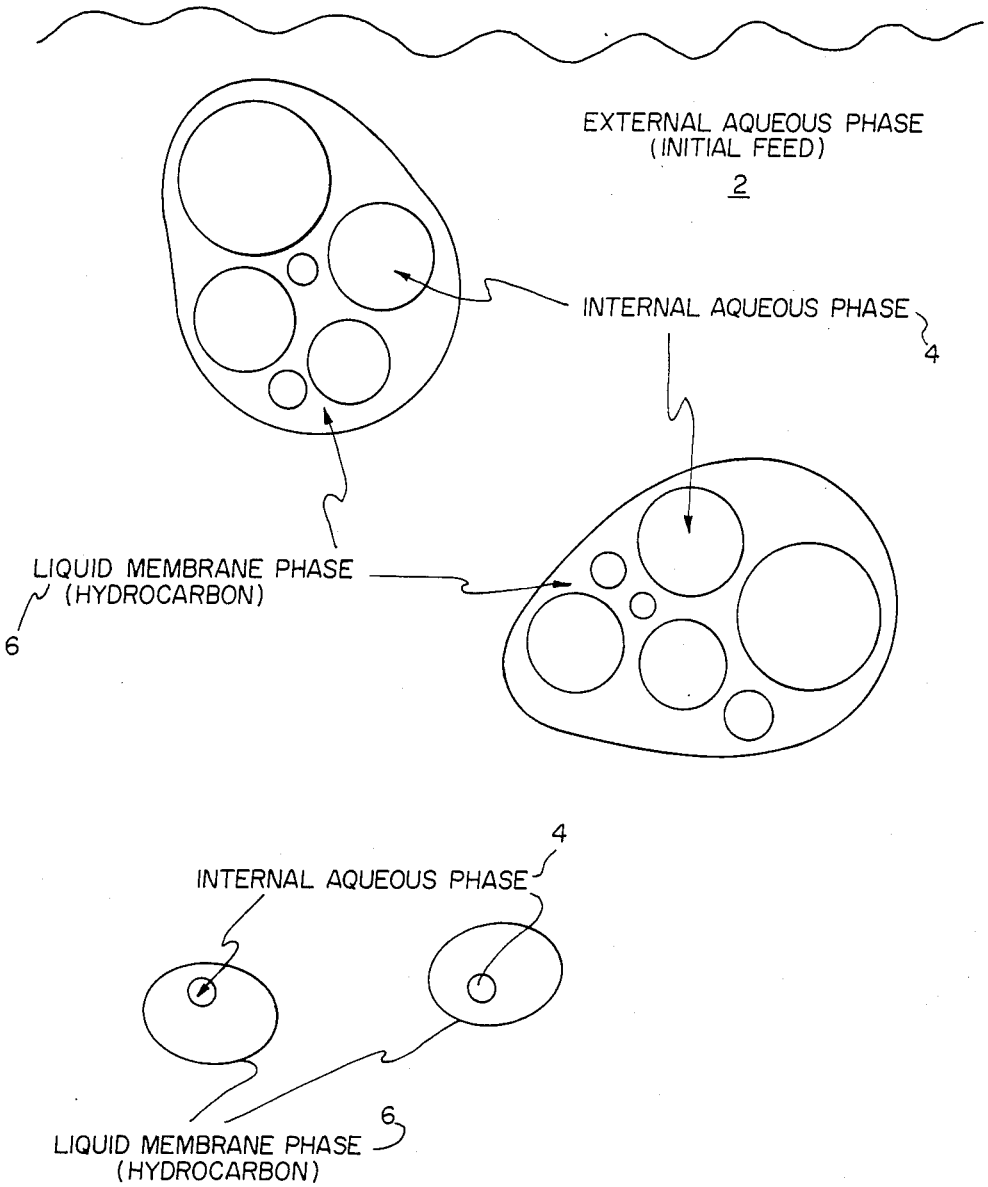
FIG. 2 is a schematic representation of a liquid membrane system.

This process provides a novel method for the dissolution of scales, particularly intractable $BaSO_4$ and $SrSO_4$. Referring to FIG. 2, a liquid membrane solvent medium for scales encountered in production equipment, flowlines, surface equipment, vessels, and wellbores typically consists of an external aqueous phase 2, which bathes said scale. Said external aqueous phase may contain concentrations of dissolved electrolytes, e.g. NaCl, $Na_2SO_4$, and KCl, in an amount normally found in seawater except that sulfates should not be used. However, the concentration of electrolyte can be greater or less than the electrolyte concentration found in seawater. The external aqueous pulse 2 may be obtained from other natural sources. These sources may comprise well water, lake water, water produced in an oil field, and other similar water sources. When using fresh water sources, electrolyte may be added to obtain an increased dissolution of said scale. To obtain a higher concentration of the scale forming ions in external aqueous phase 2, a third complexing compound having a lower complexing strength than the chelating or complexing agent used in either internal aqueous phase 4 or liquid membrane phase 6 may be used in the external aqueous phase 2. A sodium salt of ethylenediaminetetraacetic can be used as the chelating or complexing agent in the external aqueous phase. Blount et al., in U.S. Pat. No. 3,913,678 disclosed a method for removing scale from an underground hydrocarbon fluid producing formation by the use of ethylenediaminatetraacetic acid ("EDTA"). This patent is hereby incorporated by reference herein.

Internal aqueous phase 4 in the form of droplets contains one or more very strong chelating or complexing agents for $Ba^{++}$ and $Sr^{++}$ ions. Aqueous phase 4 can also contain electrolytes. A preferred chelating agent for utilization in internal aqueous phase 4 is a pentasodium salt of diethylenetriaminepentaacetic acid. Said agent is sold under the trade name Versenex 80 by Dow Chemical Company located in Midland, Mich. Versenex 80 ("Versenex") is a chelating or complexing agent for barium and is 40 percent active in water. This water soluble complexing agent complexes the barium ion more strongly than does the oil soluble complex used in liquid membrane phase 6. It also draws the barium ions out of their complex in liquid membrane phase 6 and binds them into internal aqueous phase 4.

Liquid membrane phase 6 is a non-aqueous phase, comprised preferably of liquid hydrocarbons which separate the external aqueous phase 2 from internal aqueous phase 4. Separation occurs because said non-aqueous phase forms an envelope around the internal aqueous phase 4. Said envelope contains one or more chelating or complexing agents for $Ba^{++}$ and $Sr^{++}$ which are stronger chelants than in external aqueous phase 2 and weaker than those contained in internal aqueous phase 4. Generally, said liquid hydrocarbon comprises a water-immiscible solvent which may be chosen from the class consisting of hydrocarbons, halogenated hydrocarbons, and hydrocarbons containing an oxygen atom. The oil component, of course, must be liquid at the conditions at which the instant compositions are used, must be capable of dissolving the particular additives chosen, and also must be capable, in conjunction with the particular additive, of forming a stable water in oil emulsion with the internal aqueous phase 4.

A method which is suitable for preparing a hydrocarbonaceous liquid membrane is described in U.S. Pat. No. 4,259,189 issued to Li on Mar. 31, 1981, which is hereby incorporated by reference. This patent also describes the strengthening agents, additives, surfactants which can be used in the practice of this invention for making liquid membrances. The liquid membrane phase surrounding said internal aqueous phase 4 is composed of a hydrocarbonaceous material. This hydrocarbonaceous material has combined therein a first complexing agent known as dinonylnaphthalene sulfonic acid, which is sold under the trade name Synex DN-052, which is sold by King Industries, Inc. This product is 50% active in Norpar 12 which is a trademark for a $C_{10}$—$C_{13}$ normal paraffin product of Exxon Corporation. Synex DN-052 is combined with the hydrocarbonaceous liquid which liquid is in an amount sufficient for use in removing scale from oil and gas production. Synex DN-052 will hereinafter be referred to as "Synex." Other hydrocarbons which can be used in the liquid membrane phase 6 include didecylnaphthalene sulfonic acid and didodecylnaphthalene sulfonic acid.

Having demulsified said emulsion containing the scale-forming ions from the wellbore, the wellbore, downhole production equipment, perforations and near borehole flow channels are flushed with a saltwater solution. The well is then placed back into production.

Although the present invention has been described with preferred embodiments, it is to be understood that modifications and variations may be resorted to without departing from the spirit and scope of this invention, as those skilled in the art will readily understand. Such modifications and variations are considered to be within the purview and scope of the appended claims.

We claim:

1. A method for removing scale in a wellbore, downhole production equipment and those areas of a formation where scale accumulates during the production of hydrocarbonaceous fluids comprising:

(a) removing hydrocarbonaceous fluids from said wellbore and equipment;

(b) preventing the intrusion of additional hydrocarbonanceous fluids within said wellbore;

(c) positioning a high energy impulse device within said wellbore in a manner sufficient to cause a loosening or dislodgement of scale deposits adhering to said wellbore, said equipment, or formation areas by energy generated from said device:

(d) igniting said device thereby generating energy sufficient to jar said wellbore, said equipment, or formation areas sufficiently to loosen or dislodge said scale therefrom;

(e) placing within said wellbore, said equipment, or formation areas, an emulsion with compounds sufficient to remove scale forming ions which emulsion contains an external aqueous phase and an immiscible liquid hydrocarbonaceous membrane phase enveloped around droplets of an internal aqueous phase;

(f) contacting said scale contained within said wellbore and equipment with said external aqueous phase which causes said scale to solubilize into scale-forming ions in said external aqueous phase;

(g) transferring said ions from said external aqueous phase into said hydrocarbonaceous membrane phase which contains a first complexing agent for reacting with said scale forming ions;

(h) transferring and concentrating said scale forming ions from said hydrocarbonaceous membrane phase into said internal aqueous phase which has a stronger second complexing agent than said first complexing agent; and (i) continuing the transfer of said ions from said scale into said external aqueous phase into said hydrocarbonaceous membrane phase and then into said internal aqueous phase where said ions are concentrated for a time sufficient to remove substantially all scale from said wellbore, equipment, or formation areas.

2. The method as recited in claim 1 where in step (f) said scale-forming ions comprise calcium, barium, and strontium ions.

3. The method as recited in claim 1 where in step (g) said hydrocarbonaceous membrane phase has as a first complexing agent a member selected from the group consisting of dinonylnaphthalene sulfonic acid, didecylnaphthalene sulfonic acid, and didodecylnaphthalene sulfonic acid.

4. The method as recited in claim 1 where in step (g) said hydrocarbonaceous membrane phase has as a first complexing agent dinonylnaphthalene sulfonic acid which removes barium and strontium ions from said scale-forming external aqueous phase in an amount from about 50 to about 130 times the solubility of barium sulfate and strontium sulfate in water.

5. The method as recited in claim 1 where in step (g) said first complexing agent is dinonylnaphthalene sulfonic acid and is mixed with said hydrocarbonaceous membrane phase in about 5.0 volume percent to about 25.0 volume percent, preferably about 20.0 volume percent.

6. The method as recited in claim 1 where said liquid membrane method is utilized at a temperature from above about 0° C. to about 200° C.

7. The method as recited in claim 1 where in step (h) a pentasodium salt of diethylenetriaminepentaacetic acid comprises the second complexing agent.

8. The method as recited in claim 1 where in step (h) said second complexing agent is a pentasodium salt of diethylenetriaminepentaacetic acid and is of a strength sufficient to remove barium and strontium ions from said liquid hydrocarbonaceous membrane phase in an amount from about 250 to about 650 times the solubility of barium sulfate in water.

9. The method as recited in claim 1 where in step (h) said second complexing agent is a pentasodium salt of diethylenetriaminepentaacetic acid and is mixed with said internal aqueous phase in an amount of about 5.0 volume percent to about 25.0 volume percent, preferably about 20.0 volume percent.

10. The method as recited in claim 1 where in step (e) said external aqueous phase contains at least one complexing agent.

11. The method as recited in claim 1 where in step (e) said external aqueous phase contains the sodium salt of ethylenediaminetetraacetic acid as a complexing agent.

12. The method as recited in claim 1 where said emulsion is removed from said wellbore and equipment after step (i) and steps (e) through (i) are repeated.

13. A process for removing scale from a wellbore, downhole production equipment, or areas of a formation where scale accumulates during the production of hydrocarbonaceous fluids comprising:

(a) igniting a high energy impulse device within a wellbore in a manner to cause a loosening or dislodgement of scale deposits adhering to said wellbore, said equipment, or formation areas by energy generated from said device;

(b) providing a liquid membrane system comprising a water in oil emulsion containing compounds therein sufficient to absorb scale forming ions from an external aqueous phase through an immiscible liquid hydrocarbonaceous membrane phase into said internal aqueous phase; and (c) removing said liquid membrane containing said ions from said wellbore, downhole production equipment, or areas of a formation where scale accumulates during the production of hydrocarbonaceous fluids.

14. The process as recited in claim 13 where in step (a) said device generates pressures of about 1,000 psi to about 30,000 psi and a temperature of about 100° C. to about 1,000° C.

15. The process as recited in claim 13 where in step (b) said liquid membrane is utilized at a temperature of from about 0° C. to about 200° C.

16. The process as recited in claim 13 where in step (b) said scale is comprised in part of scale-forming ions which comprise calcium, barium, and strontium ions.

17. The process as recited in claim 13 where in step (b) said hydrocarbonaceous membrane phase has as a first complexing agent dinonylnaphthalene sulfonic acid which removes barium and strontium ions from said scale-forming external aqueous phase in an amount from about 50 to about 130 times the solubility of barium sulfate and strontium sulfate in water.

18. The process as recited in claim 13 where in step (b) said hydrocarbonaceous phase contains dinonylnaphthalene sulfonic acid as a first complexing agent which is mixed with said external aqueous phase in about 5.0 volume percent to about 25.0 volume percent, preferably about 20.0 volume percent.

19. The process as recited in claim 13 where in step (b) said hydrocarbonaceous membrane phase has as a first complexing agent a member selected from the group consisting of dinonylnaphthalene sulfonic acid, didecylnaphthalene sulfonic acid, and didodecylnaphthalene sulfonic acid.

20. The process as recited in claim 13 where in step (b) said internal aqueous phase contains a second complexing agent which comprises a pentasodium salt of diethylenetriamine pentaacetic acid.

21. The process as recited in claim 13 where in step (b) said internal aqueous phase contains a second complexing agent which is a pentasodium salt of diethylenetriaminepentaacetic acid and is of a strength sufficient to remove barium and strontium ions from said liquid hydrocarbonaceous phase in an amount from about 250 to about 650 times the solubility of barium sulfate in water.

22. The process as recited in claim 13 where in step (b) said internal aqueous phase contains a second complexing agent which is a pentasodium salt of diethylenetriaminepentaacetic acid and is mixed with said liquid hydrocarbonaceous phase in an amount of about 5.0 volume percent to about 25.0 volume percent, preferably about 20.0 volume percent.

23. The process as recited in claim 13 where in step (b) said external phase contains at least one complexing agent.

24. The process as recited in claim 13 where in step (b) said external aqueous phase contains the sodium salt of ethylenediaminetetraacetic acid as a complexing agent.

25. The process as recited in claim 13 where in step (b) said emulsion is removed from said wellbore, equipment, and formation areas.

26. The process as recited in claim 13 where said emulsion is removed from said wellbore, equipment, near wellbore flow channels and step (c) is repeated.

27. A process for removing scale from a flowline above ground surface equipment, such as containment vessels where scale accumulates comprising:

(a) igniting a high energy impulse device within said flowline or surface equipment in a manner to cause a loosening or dislodgement of scale deposits adhering to said wellbore, said flowline or equipment by energy generated from said device;

(b) providing a liquid membrane system comprising a water in oil emulsion containing compounds therein sufficient to absorb scale forming ions from an external aqueous phase through an immiscible liquid hydrocarbonaceous membrane phase into said internal aqueous phase; and (c) removing said liquid membrane containing said ions from said flowline or surface equipment where scale accumulates.

28. The process as recited in claim 27 where in step (b) said liquid membrane is utilized at a temperature of from about 0° C. to about 200° C.

29. The process as recited in claim 27 where in step (b) said scale is comprised in part of scale-forming ions which comprise calcium, barium, and strontium ions.

30. The process as recited in claim 27 where in step (b) said hydrocarbonaceous membrane phase has as a first complexing agent dinonylnaphthalene sulfonic acid which removes barium and strontium ions from said scale-forming external aqueous phase in an amount from about 50 to about 130 times the solubility of barium sulfate and strontium sulfate in water.

* * * * *